United States Patent [19]

Rhodes

[11] Patent Number: 4,804,452

[45] Date of Patent: Feb. 14, 1989

[54] ELECTROLYTIC PROCESSOR

[75] Inventor: Curtis O. Rhodes, Portageville, N.Y.

[73] Assignee: CPAC, Inc., Leicester, N.Y.

[21] Appl. No.: 204,307

[22] Filed: Jun. 14, 1988

[51] Int. Cl.[4] ..... C25B 15/08; C25B 9/00; C25C 7/00

[52] U.S. Cl. ..... 204/238; 204/272; 204/275

[58] Field of Search ..... 204/237–238, 204/272, 275

[56] References Cited

U.S. PATENT DOCUMENTS

| | | | |
|---|---|---|---|
| 858,341 | 6/1907 | Harrison et al. | 204/212 |
| 3,003,942 | 10/1961 | Cedrone | 204/272 |
| 3,065,153 | 11/1962 | Hough et al. | 204/237 X |
| 3,702,814 | 11/1972 | Mandroian | 204/237 |
| 4,149,954 | 4/1979 | Ransbottom | 204/272 |
| 4,280,884 | 7/1981 | Babb et al. | 204/109 |
| 4,302,317 | 11/1981 | Mock | 204/228 |
| 4,612,102 | 9/1986 | Brimo et al. | 204/228 |
| 4,634,503 | 1/1987 | Nogavich | 204/27 |

OTHER PUBLICATIONS

"Applying Plating Solution to a Plurality of Piece Parts", G. C. Gouty, Western Electric, Technical Digest No. 1, Jan. 1966.

*Primary Examiner*—Donald R. Valentine

*Attorney, Agent, or Firm*—Stonebraker, Shepard & Stephens

[57] ABSTRACT

A cathode (10) surrounding an anode (14) stands on the bottom (11) of a tank (12) that can hold a varying volume of liquid (25) for electrolytic processing. A pump (18) circulates liquid from a drain (17) outside the cathode into a space between the cathode and anode; and although liquid can drain from inside the cathode back into the tank under the bottom of the cathode, the flow rate of the pump is larger so that the pump fills the cathode to overflowing, independently of the level of liquid in the tank. This allows widely varying batch sizes to be processed in a simple and inexpensive way; and it ensures that when tank (12) is drained, liquid (25) within cathode (10) also drains.

20 Claims, 1 Drawing Sheet

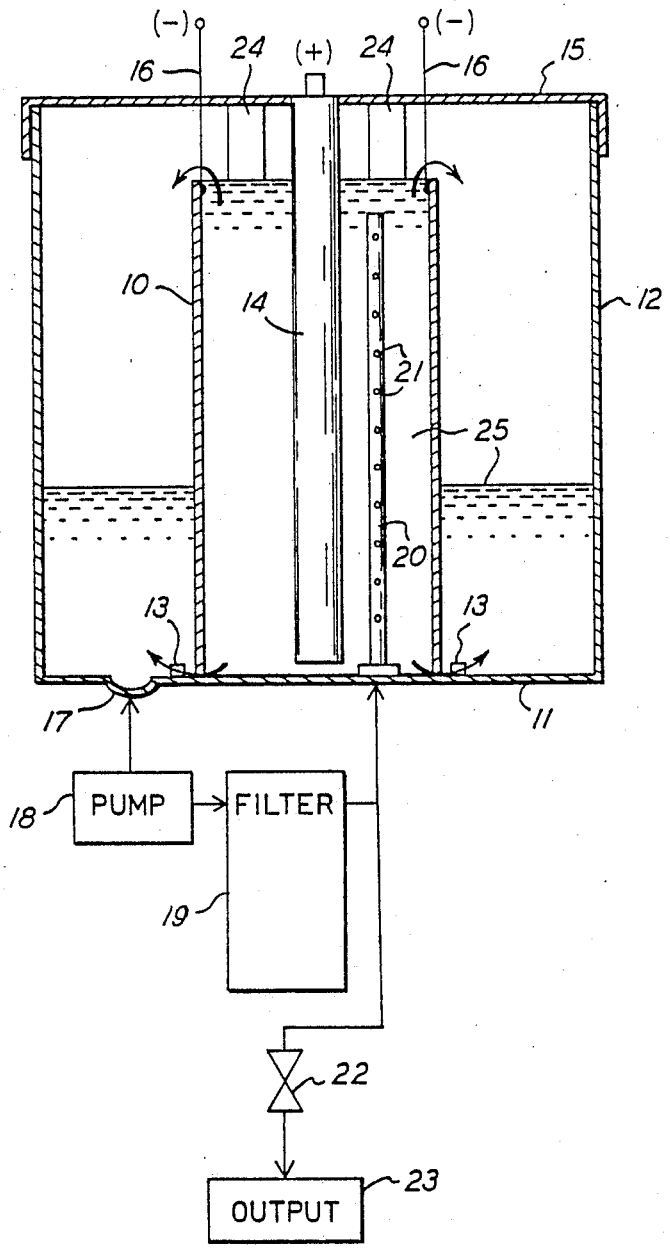
(−)
(+)
(−)
24
24
16
16
15
10
14
12
21
25
20
13
13
17
11
18
PUMP
FILTER
19
22
23
OUTPUT

ELECTROLYTIC PROCESSOR

BACKGROUND

Electrolytic processors have used a variety of anode, cathode, tank, and pump arrangements for disposing a liquid to be processed between an anode and cathode. I have discovered a simpler and less expensive way of arranging these components to produce several advantages. My arrangement not only reduces cost, but assures that a predetermined volume of liquid is contained within a cathode during processing, regardless of variations in batch sizes of the total amount of liquid to be processed. My processor can accept widely varying batch sizes and reliably circulate these between the anode and cathode, with minimal equipment being involved.

SUMMARY OF THE INVENTION

In my electrolytic processor a cathode capable of retaining liquid stands on the bottom of a tank that can hold varying volumes of liquid for processing. The liquid is pumped from a drain outside the cathode into a space within the cathode, where the liquid can rise to the top of the cathode and overflow back into the tank. Liquid can also flow slowly under the bottom of the cathode into the bottom of the tank, but the flow rate of the pump is larger than the backflow rate under the cathode, so that the pump can keep the cathode full. This assures that the space between the anode and cathode is full of liquid up to the electrolytic processing level at the top of the cathode, whether the tank contains large or small batches of liquid to be processed.

The flow underneath the cathode is useful in draining the tank, when the entire batch is processed, because the liquid within the cathode flows back into the tank and into the tank drain, as the tank is emptied. I prefer that guides on the tank bottom locate the bottom of the cathode, without blocking the small liquid flow underneath the bottom of the cathode; and I also prefer that the liquid be filtered as it is pumped through the cathode.

DRAWING

The drawing schematically shows a preferred embodiment of my invention.

DETAILED DESCRIPTI0N

I stand a cathode 10 on a bottom 11 of a tank 12 that can hold varying volumes of liquid 25 for processing. It is possible to simply stand cathode 10 upright on tank bottom 11; but I prefer that guides 13, projecting upward from tank bottom 11, locate the bottom of cathode 10 in position. Guides 13 can be arranged inside or outside of cathode 10 and are preferably not continuous, so as not to interfere with the slow flow of liquid underneath the bottom of cathode 10. A gasket, and particularly a porous gasket, can also be arranged around the bottom of cathode 10. None of these measures produces a liquid tight connection between the bottom of cathode 10 and tank bottom 11, so that liquid within cathode 10 is free to flow slowly underneath the bottom of cathode 10 and into the bottom of tank 12, as indicated by the arrows.

I dispose an anode 14 within cathode 10; and although this can be done many ways, I prefer connecting anode 14 to a cover 15 over tank 12 so that anode 14 depends from cover 15. Then whenever cover 15 is in place, anode 14 extends downward within cathode 10 and into proximity with tank bottom 11. An electric connection (not shown) is conveniently made to anode 14 at cover 15, and I also prefer that electric leads 16 to cathode 10 be secured through cover 15. Tabs 24 connect cathode 10 to cover 15, and tabs 24 stand tall enough so that the weight of cover 15 and dependent anode 14 bears down on tabs 24 and cathode 10 to press the bottom of cathode 10 snugly against tank bottom 11. The downward pressure of cover 15, combined with the location of cathode 10 by guides 13, ensures that cathode 10 stands squarely and firmly on tank bottom 11 so that the small flow of liquid underneath the bottom of cathode 10 is consistent.

A drain 17, preferably in tank bottom 11, allows outflow from tank 12 to pump 18 and filter 19. Many different filter and pump arrangements are possible, but I prefer that filter 19 be in series with pump 18 for removing solids from liquid 25. Pump 18 delivers liquid into cathode 10, in the space between anode 14 and cathode 10. Again, this can be done many ways, depending on whether agitation is desired. For an agitated or swirling flow within cathode 10, I prefer that liquid be delivered through pipe 20, having nozzle holes 21. Valve 22 allows liquid flow to be diverted to a drain or output 23, when a batch of liquid is fully processed.

A minimum batch size for liquid 25 in tank 12 includes a volume large enough to circulate through pump 18 and fill cathode 10. For a maximum batch size, liquid 25 can fill tank 12 to the level of the top of cathode 10, or even higher, so that my processor can accommodate widely varying batch sizes.

The liquid 25, circulated by pump 18 into cathode 10, rises to the top of cathode 10 and overflows back into tank 12, as shown by the arrows. The flow rate of pump 18 exceeds the liquid backflow rate from inside cathode 10 underneath the bottom of cathode 10 and into the bottom of tank 12, so that pump 18 supplies liquid to cathode 10 faster than the liquid can drain back into tank 12, underneath the bottom of cathode 10. This ensures that cathode 10 fills up to the electrolytic processing level at the top of cathode 10, where the liquid overflows, independently of the level of liquid 25 in tank 12 outside of cathode 10.

Since cathode 10 is filled to overflowing during operation, the space between anode 14 and cathode 10 is constantly supplied with liquid, regardless of the batch size of liquid 25 in tank 12. The circulation provided by pump 18 ensures that all of the liquid 25 passes through the space between anode 14 and cathode 10 for full electrolytic processing, and filtering, if desired. When the processing is completed, liquid 25 is pumped to output 23; and as this occurs, liquid within cathode 10 drains down under the bottom of cathode 10 and into drain 17 so that when tank 12 is empty, so is the space within cathode 10.

I claim:

1. An electrolytic processor comprising:

a. a tank capable of holding varying volumes of liquid for processing;

b. a cathode standing on a bottom of said tank and extending above said tank bottom to an electrolytic processing level;

c. said cathode being able to retain liquid up to said electrolytic processing level, and liquid within said cathode being able to flow slowly from the bottom of said cathode into the bottom of said tank;

d. an anode arranged within said cathode and extending below said electrolytic processing level and into proximity with said tank bottom;

e. a pump arranged for circulating liquid from a tank drain outside said cathode to a region inside said cathode; and f. the liquid flow rate into said cathode from said pump exceeding the liquid outflow rate from the bottom of said cathode into the bottom of said tank so that said pump fills said cathode up to said electrolytic processing level, independently of the level of liquid in said tank outside said cathode.

2. The processor of claim 1 including guides on said tank bottom adjacent said bottom of said cathode for positioning said cathode on said tank bottom.

3. The processor of claim 1 including a filter in series with said pump.

4. The processor of claim 1 wherein said liquid at said electrolytic processing level overflows said cathode and returns to said tank outside said cathode.

5. The processor of claim 1 wherein said drain is in said tank bottom.

6. The processor of claim 1 wherein said tank has a cover and said anode is dependent from said cover.

7. The processor of claim 6 wherein said cathode is attached to said cover so that said cover presses said cathode against said tank bottom.

8. The processor of claim 1 wherein said liquid in said cathode flows to said drain when said tank is drained empty.

9. A method of operating an electrolytic processor, said method comprising:

a. supplying to a tank variable volumes of a liquid to be processed electrolytically;

b. arranging a cathode to extend around an anode and to stand on a bottom of said tank so that said cathode can retain said liquid, which slowly flows from the bottom of said cathode into the bottom of said tank; and c. pumping said liquid from said tank into said cathode at a rate faster than said liquid can flow from said cathode into said tank under the bottom of said cathode so that said cathode fills to overflowing independently of the level of said liquid in said tank outside of said cathode.

10. The method of claim 9 including filtering said liquid as it is pumped from said tank into said cathode.

11. The method of claim 9 including arranging guides for said cathode on said tank bottom.

12. The method of claim 9 including depending said anode from a cover over said tank.

13. The method of claim 12 including using said cover to press said cathode downward against said tank bottom.

14. A system of dynamically filling a cathode extending around an anode of an electrolytic processor, said system comprising:

a. said cathode being arranged to stand on the bottom of a tank that can contain varying volumes of a liquid to be processed electrolytically;

b. said cathode being able to retain said liquid above said tank bottom, and said liquid being able to flow slowly under the bottom of said cathode into said tank;

c. a pump arranged for circulating said liquid from a drain in said tank outside said cathode to a region inside said cathode; and d. said pump having a flow rate that exceeds the rate of flow of said liquid from said cathode back into said tank underneath said bottom of said cathode, so that said pump fills said cathode to overflowing, independently of the level of said liquid in said tank outside said cathode.

15. The system of claim 14 including a filter for said liquid, arranged in circuit with said pump.

16. The system of claim 14 wherein guides on said tank bottom locate said bottom of said cathode on said tank bottom.

17. The system of claim 14 wherein said drain is in said tank bottom.

18. The system of claim 14 wherein said liquid in said cathode flows to said drain when said tank is drained empty.

19. The system of claim 14 wherein said anode is dependent from a cover over said tank.

20. The system of claim 19 wherein said cathode is attached to said cover so that said cover presses said cathode downward against said tank bottom.

* * * * *